US006178866B1

(12) United States Patent
Searle et al.

(10) Patent No.: US 6,178,866 B1
(45) Date of Patent: Jan. 30, 2001

(54) FIELD HOWITZERS

(75) Inventors: Harold Leslie Searle; David Andrew Eaglestone, both of Barrow-in-Furness; James Bone, Ulverston, all of (GB)

(73) Assignee: Vickers Shipbuilding & Engineering Limited, Cumbria (GB)

( * ) Notice: Under 35 U.S.C. 154(b), the term of this patent shall be extended for 0 days.

(21) Appl. No.: 08/460,006

(22) Filed: Jun. 7, 1995

Related U.S. Application Data

(62) Division of application No. 08/038,088, filed on Mar. 29, 1993, now Pat. No. 6,024,007, which is a continuation of application No. 07/456,818, filed on Dec. 13, 1989, now abandoned.

(30) Foreign Application Priority Data

Dec. 14, 1988 (GB) ..... 8829192

(51) Int. Cl.[7] ..... F41A 27/30

(52) U.S. Cl. ..... 89/37.08; 89/37.07; 89/37.13; 89/40.04; 89/40.09; 89/43.01; 89/42.02

(58) Field of Search ..... 89/37.08, 43.01, 89/43.02, 42.01, 42.02, 37.05, 37.07, 37.13, 40.02, 40.09, 41.02, 37.02, 40.01, 40.04, 41.12

(56) References Cited

U.S. PATENT DOCUMENTS 499,530 * 6/1893 Fletcher ..... 89/41.02
1,185,326 * 5/1916 Humphreys ..... 89/41.02
1,396,064 * 11/1921 Schneider ..... 89/37.08
2,088,600 * 8/1937 Karnes ..... 89/71.02
2,382,225 * 8/1945 Hochstetler ..... 89/37.05
2,415,024 * 1/1947 Allen ..... 89/37.08
3,033,085 * 5/1962 Witkin ..... 89/37.08

FOREIGN PATENT DOCUMENTS

344645 * 3/1960 (CH) ..... 89/41.02
235943 * 6/1911 (DE) ..... 89/37.08
3310355 * 9/1984 (DE) ..... 89/37.08
375693 * 6/1932 (GB) ..... 89/37.08
104043 * 3/1942 (SE) ..... 89/37.05

* cited by examiner

*Primary Examiner*—Stephen M. Johnson
(74) *Attorney, Agent, or Firm*—Pollock, Vande Sande & Amernick

(57) ABSTRACT

Improvements in or relating to field howitzers A light weight field howitzer includes a barrel which is supported by a cradle constructed from hollow members and which is pivotally mounted about a trunnion bearing secured to a chassis. The trunnion bearing lies on the barrel axis and is positioned beyond the limit of maximum recoil of the barrel. Front stabilisers and rear trail support legs are provided to spread the load of the howitzer and spades are rigidly secured to the chassis. The howitzer includes a single hydraulic accumulator arrangement constituting a combined recoil buffer and recuperator system. A barrel elevating means is provided comprising a geared manual means assisted by a precompressed gas system.

8 Claims, 10 Drawing Sheets

FIELD HOWITZERS

This application is a divisional of U.S. patent application Ser. No. 08/038,088, filed Mar. 29, 1993, now U.S. Pat. No. 6,024,007 which is continuation of U.S. patent application Ser. No. 07/456,818, filed Dec. 13, 1989, now abandoned.

This invention relates to field howitzers and is concerned with the application, to field howitzers, of design techniques and philosophies not normally associated with the design of field artillery in order to produce such weapons having an absolute minimum of weight, yet still retaining all the other features required by such equipment, e.g range, reliability, accuracy, rate of fire, stability, robustness of construction etc.

The existence of rapid deployment forces is well known and it is desirable that the range of equipment available to these forces is as wide as reasonably possible. There is a need for the equipment available for these forces to include field artillery.

Newton's Third Law of Motion states that for every action, there is an equal and opposite reaction. Thus for field howitzers which can fire a heavy projectile over a great range, the recoil presents a particular problem. One means to minimise the recoil problem is to have heavy ordnance. However, a main purpose of the present invention is to minimise weight and it is an object of the invention to dissipate the recoil forces on light ordnance by the combination of:

i) optimised recoil buffer efficiency, ii) optimised muzzle brake efficiency, and iii) a new design concept that takes the resultant recoil forces directly to spades via a damped, energy-absorbing means.

For a conventional field howitzer, which is intended to be air liftable, air dropable and moved around a battle field with comparative ease, a relatively light (though still robust) chassis is required. To increase stability and spread the recoil forces, one method is to deploy a pair of trail legs with 'spades' at their further ends; the purpose of the spades is to dig into the ground and so absorb the recoil force. Despite their construction, such conventional field howitzers are far too heavy to be carried by the small or medium lift helicopters used near the actual battle zone.

NATO is in the process of standardising ordnance and ammunition systems into a single calibre. There is thus a need for an ultra lightweight version of the standard 155 mm field howitzer which can be transported as a single unit by a battlefield helicopter.

According to a first aspect of the present invention, there is provided a field howitzer which comprises:

i) a howitzer barrel, ii) a cradle supporting the barrel and having a rearward end, iii) a chassis, and iv) a trunnion support structure secured to the chassis and including a trunnion bearing about which the rearward end of the cradle is pivotally mounted, said trunnion bearing lying on the axis of the barrel and being positioned beyond the limit of maximum recoil of the barrel.

The trunnion bearing should be placed as low as possible consistent with the other requirements of a field howitzer (e.g training, towing, loading etc.) and the location of the trunnion bearing beyond the point of maximum recoil so that the barrel does not recoil through the trunnion bearing enables this to be achieved and also ensures that the howitzer exhibits a high degree of out-of-balance.

In order to enable the field howitzer to be as light in weight as possible, the chassis should be a lightweight chassis and weight saving design principles should be used in the construction of the other components of the howitzer.

This aspect of the invention combines features of both a field howitzer and a mortar and the minimum trunnion height greatly facilitates the transfer of the recoil forces to the ground. The weight saving design principles employed include the use of lightweight strong alloys, integral construction, etc. The single lightweight chassis should rest on the ground, as opposed to the conventional chassis which rests on a sole plate which is in contact with the ground. This feature is a radical change from previous design practice.

The position of the trunnion support structure on the chassis is basically the same as for other field howitzers. However, relative to conventional designs, the barrel is moved forward so that the whole of it, including the whole of the supporting cradle, whether in the ready-to-fire position, or the maximum recoil position, is always forward of the trunnion bearing. This leads to a intermediate and high degree of out-of-balance which acts to oppose the recoil moment, particularly when the gun is fired at low angles of elevation e.g., from −2.5 °to 70°.

In a preferred embodiment, spades are secured directly to the chassis and the howitzer includes front stabilisers and rear trail support legs operable to spread the load over a large area of ground when not being fired, the latter also assisting to absorb recoil energy whilst resisting overturning and lateral forces.

Such spades, stabilisers and support legs may be incorporated in howitzers other than those of the type having a trunnion bearing lying on the barrel axis beyond the maximum recoil limit in accordance with the first aspect of the invention.

Accordingly, a second aspect of the present invention provides a field howitzer comprising:

i) a chassis, ii) spades rigidly secured to the howitzer chassis;

iii) front stabilisers operable to spread the load of the howitzer over a large area of ground when not being fired; and iv) rear trail support legs operable to spread the load of the howitzer over a large area of ground and to assist with the absorbing of recoil energy while providing overturning and lateral stability.

Preferably the spades are of the 'self-digging' type so that they will be fully effective as the first round is discharged. The attachment of the spades directly to the rear of the chassis in conjunction with a low trunnion bearing height provides an essentially rigid means of restraining the gun during recoil. Front stabilisers and trail legs generally improve stability and hence the aiming of the gun, but also play a part in the absorption of recoil energy. The term 'trail legs' is a generally accepted term in this type of howitzer. Although it is not intended that the howitzer of the invention be towed by 'trail legs', the term is retained for descriptive consistency.

The spades may be secured directly to the chassis or they may be secured to the ends of the rear trail support legs provided that they are relatively short and inflexible Preferably the spades are removable when the howitzer is in the mode for being towed/transported.

In a preferred embodiment, the rear trail support legs are hingedly mounted on the chassis and hydraulic dampers are provided at, or near, the attachment points of the rear trail legs to the chassis to assist with the absorbing of recoil energy. These dampers for the rear trail legs can automatically compensate for uneven ground and give protection against excessive recoil forces.

In a further embodiment, the howitzer barrel is mounted on the chassis so as to be displaceable from a first to a second position with respect to the chassis, as a consequence of recoil on firing and the howitzer includes a recoil buffer system to absorb the energy of recoil as the barrel is displaced on firing, and also a recuperator system to return the displaced barrel from the second position to the first position, said recoil buffer system and said recuperator system being combined and utilising a single hydraulic accumulator arrangement.

Such a combined recoil buffer/recuperator system can be utilised with howitzers which are other than of the type defined in accordance with the first and second aspects of the invention.

Accordingly, a third aspect of the present invention provides a field howitzer comprising:

i) a chassis, ii) a howitzer barrel mounted on the chassis so as to be displaceable from a first to a second position with respect to the chassis, as a consequence of recoil on firing, iii) a recoil buffer system to absorb the energy of recoil as the barrel is displaced on firing, and iv) a recuperator system to return the displaced barrel from the second position to the first position, said recoil buffer system and said recuperator system being combined and utilising a single hydraulic accumulator arrangement.

In a particularly preferred embodiment, the barrel is supported in a trunnion support structure by means of a cradle and the cradle is constructed from hollow members, the space inside said hollow members being used wholly, or in part, to provide the volume for the compressed inert gas forming part of said single hydraulic accumulator arrangement.

The hydraulic accumulator arrangement of the combined recoil buffer system and recuperator system serves as a 'spring' which absorbs some of the energy of the recoiling barrel. The energy absorbed is subsequently released in a controlled manner to run out the barrel to the firing position. Hydraulic accumulators operate against a given volume of compressed inert gas. The 'spring constant' is determined by the volume of gas and the amount by which this is reduced by the compression caused by the volume of hydraulic fluid displaced by the recoil. To provide a relatively uniform 'spring constant', a large volume of gas is required compared with the volume of fluid displaced. As it is desirable to allow the barrel to have as long a recoil as possible, a fairly large volume of hydraulic fluid needs to be displaced and hence as large a volume of gas as possible is required. As the weight of thick walled pressure-resistant gas cylinders would be excessive, the gas volume may be provided by using the bores of two of, say, the four hollow structural members which form the gun cradle. Interconnecting passages may be provided to allow the gas pressure to be equalised between said two members, if required.

In an embodiment, the howitzer includes an elevating means for pivoting the barrel about a horizontal axis, said elevating means comprising a geared manual means assisted by precompressed gas.

Such an elevating means can be incorporated in howitzers which are not constructed in accordance with the first, second and third aspects of the invention.

Accordingly, a fourth aspect of the present invention comprises a field howitzer comprising i) a chassis;

ii) a howitzer barrel supported in a cradle and mounted in a trunnion bearing on the chassis so as to be pivotable about a horizontal axis, and iii) elevating means for pivoting the barrel about said axis, said elevating means comprising a geared manual means assisted by precompressed gas.

In a particularly preferred embodiment the howitzer barrel is mounted so as to be out-of-balance and the degree of assistance provided by the precompressed gas is sufficient to substantially counterbalance the barrel weight due to its positive out-of-balance.

Preferably the barrel weight is balanced by gas springs consisting of cylinders pressurised by an inert gas reservoir acting on pistons in the cylinders. In the case where the cradle is constructed from hollow members, the space inside the hollow members may be used, wholly or in part, to provide the volume for the gas. If some of the, say, four hollow members of the cradle are used for the combined recoil buffer recuperator system as above described, the remaining hollow members may be used for the gas for the elevating means. The gas connection between the hollow members and the cylinders of the gas springs may either be via flexible pressure-resistant tubes or via a bore down the axis of the piston rods of the pistons with the other ends of the rods secured to said hollow members. The actual elevation of the barrel is effected by means of a geared drive via a handwheel, but this would involve minimal physical effort because of the counterbalancing action. The gas springs may also incorporate hydraulic fluid, if required.

In a particularly preferred embodiment, the elevating means comprises a lead screw, essentially pivotally fixed at one end and along which a nut may be screwed, said nut being fixed relative to the cradle for the barrel of said howitzer but rotatable so that the resulting translational movement of said nut along said lead screw causes said cradle to move in a rotary direction about the trunnion bearing, thus elevating/depressing the barrel of the howitzer. Preferably the nut is readily rotated, e.g via a handwheel and gearing, and a reverse locking means is employed.

It is particularly preferred for the essentially pivotally fixed end of said lead screw to be provided with a flexible tunable mounting comprising;

i) a spring means aligned parallel to the axis of said lead screw, and ii) a damper; wherein the spring constant, pre-load and resistance to motion provided by the damper are adjustable to give a tunable system. Preferably the spring comprises a series of spring washers and the damper is hydraulic.

In an embodiment the howitzer barrel is mounted on the chassis by means of a training bearing so as to be pivotable about a vertical axis and said training bearing comprises (a) a small central locating bearing having inner and outer bearing surfaces one of which is fast with the chassis and the other of which is fast with a support for the barrel and (b) a separate large diameter thrust bearing formed as part of a concentric arc on the opposite side of said small central locating bearing to the barrel.

Such a training bearing may be incorporated in a howitzer which is not constructed in accordance with the first, second, third and fourth aspects of the invention.

Accordingly, a fifth aspect of the present invention provides a field howitzer comprising:

i) a chassis, ii) a howitzer barrel mounted on the chassis by means of a training bearing so as to be pivotable about a vertical axis, said training bearing comprising (a) a small central locating bearing having inner and outer bearing surfaces one of which is fast with the chassis and the other of which is fast with a support for the barrel and (b) a separate large diameter thrust bearing formed as part of a concentric arc on the opposite side of said small central locating bearing to the barrel.

Preferably the howitzer includes a training rack integral with a part of the thrust bearing arc.

In an embodiment, the howitzer barrel includes a muzzle brake and a hinged lunette attached to the barrel adjacent to the muzzle brake to enable the howitzer to be towed.

Such a muzzle brake and lunette may be incorporated in a howitzer which is not constructed in accordance with the first to the fifth aspects of the invention.

Accordingly, a sixth aspect of the present invention provides a field howitzer comprising:

i) a chassis;

ii) a howitzer barrel mounted on the chassis, iii) a muzzle brake on the barrel, and iv) a hinged lunette attached to the barrel adjacent to the muzzle brake to enable the howitzer to be towed.

It is common for conventional designs of howitzer to be towed by the (rear) trail legs. The novelty in the sixth aspect of the invention is that the towing attachment is secured to the barrel, just behind the muzzle brake, and hinged forward to project beyond-the muzzle brake to co-operate with the hook on the towing vehicle. In the case where the gun is out-of-balance, this will provide a net downward load on the towing hook, which is normal towing practice.

It is particularly preferred, in all aspects of the invention, for the howitzer to be constructed in a manner which enables it to be quickly and easily separated into two or more parts which can readily be reassembled. The advantage of a howitzer which can be separated into one or more component parts and easily reassembled is that transport problems are greatly reduced if two light sections have to be moved instead of one heavier one. In this context, transport may be by vehicle or helicopter on or near a battlefield or by aircraft, ship or road vehicle to or from the scene of conflict. Smaller sections of a howitzer may pack better in a ship or aircraft when many have to be transported. A further advantage is that damaged parts may be repaired by replacement of a whole section.

For a better understanding of the invention and to show how the same may be carried into effect, reference will now be made, by way of example only, to the accompanying drawings, in which:

DESCRIPTION OF THE PREFERRED EMBODIMENT

The present invention represents an innovative concept in the design of field howitzers. The main theme behind the design process is to produce an ultra lightweight version of the current standard NATO 155 mm ordnance. This design process has led to the adoption of a large number of innovative features, including the following features either singly or in any combination of two or more:

1. greatly lowered trunnion bearing height.

2. location of the whole of the barrel, including full recoil length, forward of the trunnion bearing.

3. a single fabricated chassis, with a spherically or cylindrically convex lower surface to act as a combined chassis and sole plate.

4. self-digging spades attached directly to the chassis.

4a. self-digging spades attached at or near the ends of short, inelastic rear trail legs.

5. positive out-of-balance in all non-firing attitudes.

6. front stabilisers to counteract the out-of-balance when in normal ready-to-fire attitudes.

7. short light rear trail legs designed to resist only overturning effects rather than full recoil loading.

7a. short robust rear trail legs designed to resist overturning forces and transmit recoil forces via the spades into the ground.

8. hydraulic dampers in or near the rear trail leg and a chassis hinge to assist with transfer of recoil energy, yet protect the trail legs from damage due to excessive loadings.

9. a combined recoil and recuperator system.

10. the use of the hollow interiors of structural members forming the cradle to provide additional accumulator gas volume.

11. counterbalancing of the barrel using gas cylinders and a pressurised gas reservoir located in the hollow interiors of other structural members.

12. provision for towing by the muzzle of the barrel and using the out-of-balance to provide safer towing.

13. damped elevation gearing system.

14. resetting (rendering) device in the elevation system.

15. minimum size training bearing.

16. segmental arc training gear (rather than full gear ring) incorporating a pre-loaded thrust bearing arrangement.

17. extensive use of lightweight materials, such as titanium alloys, and aerospace technology.

Figure 1:
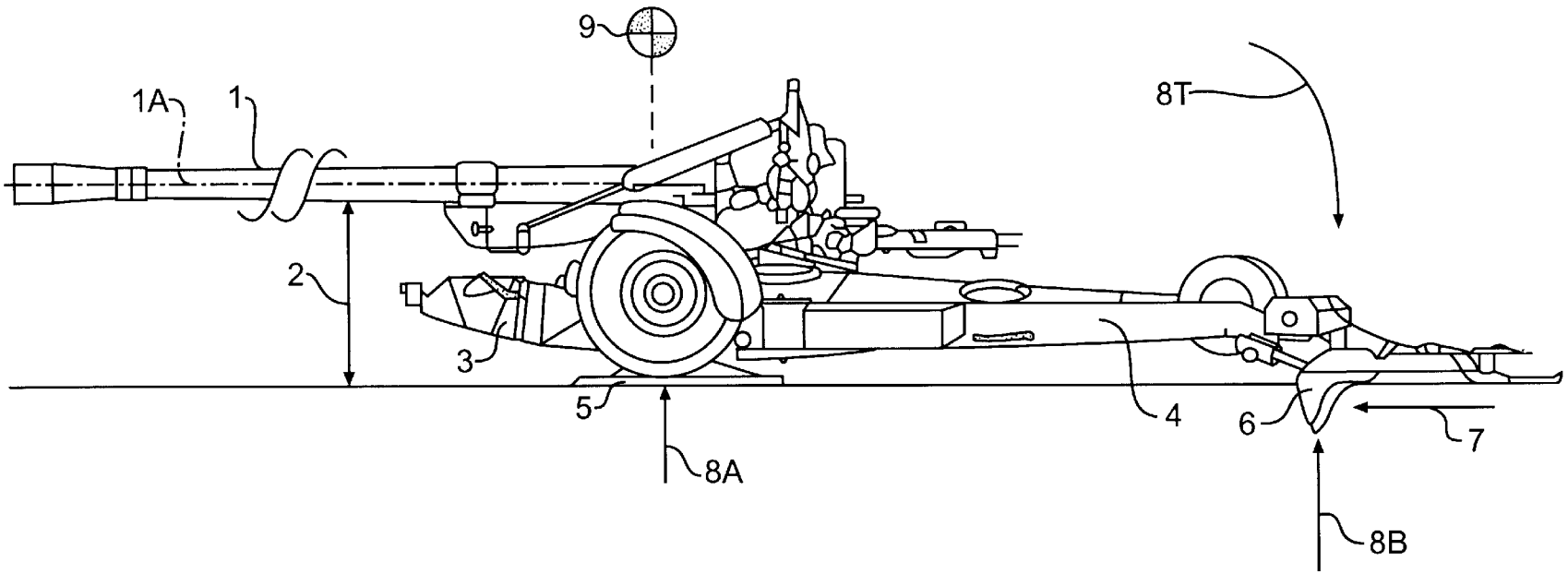
FIG. 1 shows a side elevation of a conventional 155 mm field howitzer in a ready-to-fire position.

FIG. 1 shows a current design of 155 mm field howitzer in a ready-to-fire position. The barrel 1 is horizontal and located in a trunnion carried on a substantial chassis 3. The height of the trunnion is such that the barrel axis 1A is a relatively large distance 2 from the ground. Two trail legs 4, which are splayed out, and sole plate 5 give a stable 3-point support. A spade 6 near the end of each trail leg 4 is designed to 'dig' into the ground as the howitzer is fired and so provide the horizontal reaction 7 to the horizontal component of the recoil force. When firing at an elevated angle, the vertical components 8A and 8B of the recoil reaction are taken at the sole plate 5 and spades 6 via legs 4, respectively. In order to withstand the horizontal reaction 7, vertical component 8B and turning component 8T of the recoil forces, trail legs 4 are substantial box-section members. A further benefit of trail legs 4 is that their weight acts as a counterbalance to that of barrel 1 to bring the centre of gravity 9 above sole plate 5.

Though the trail legs 4 are substantial boxsection members, they still act as 'springs' when the gun is discharged. If the howitzer were to be discharged in the attitude shown in FIG. 1, there would be no vertical component in the recoil. Instead the recoil would consist of a horizontal force (balanced by reaction 7) and a turning moment 8T (caused because the line of reaction 7 is off set from the barrel axis 1A which is the line of action of the force). As the howitzer is fired, the horizontal component of the recoil forces the main body of the howitzer to move backwards. As spades 6 should not move, this component of the recoil would cause the two splayed out trail legs 4 to distort and absorb strain energy as they transferred the recoil energy to spades 6. Because there is also a turning moment 8T in the recoil, sole plate 5 may be lifted off the ground. As the energy of the recoil is dissipated by spades 6, so the strain energy in trail legs 4 will be released causing the main body of the howitzer to move back to (and possibly overshoot) its original position. At the same time, the main body of the howitzer falls back onto the ground. Thus the prior art design, with spades 6 at the ends of trail legs 4 leads to a fairly violent motion of the howitzer under recoil.

Figure 2:
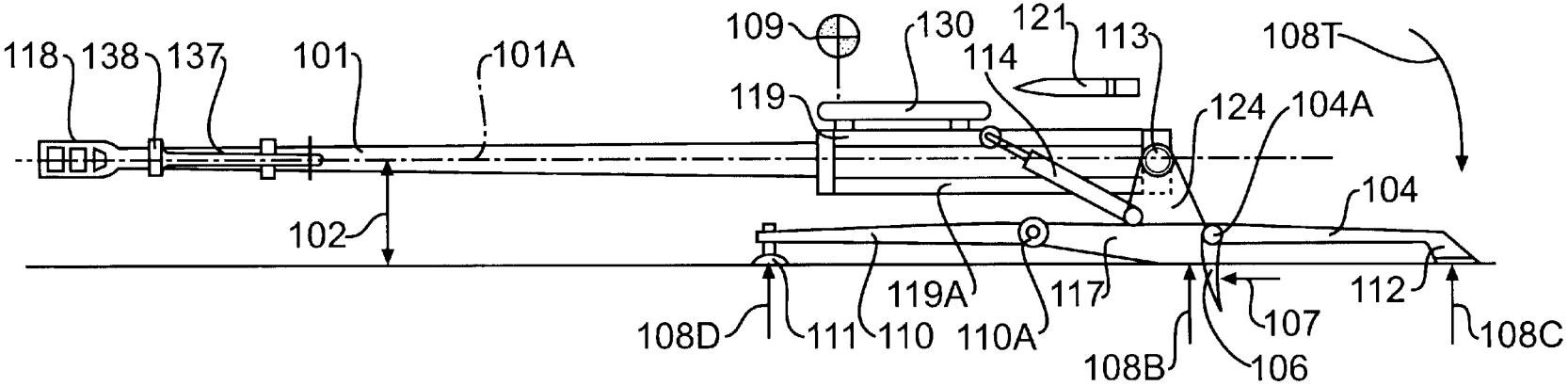
FIG. 2 shows a side elevation of an ultra lightweight 155 mm field howitzer of the present invention in a ready-to-fire position.

FIG. 2 shows a side elevation of the ultra lightweight howitzer according to the invention. The design is based upon:

i) a geometrically optimised weapon configuration;

ii) sensible use of available high strength lightweight materials; and iii) the minimising of the recoil forces.

Figure 3:
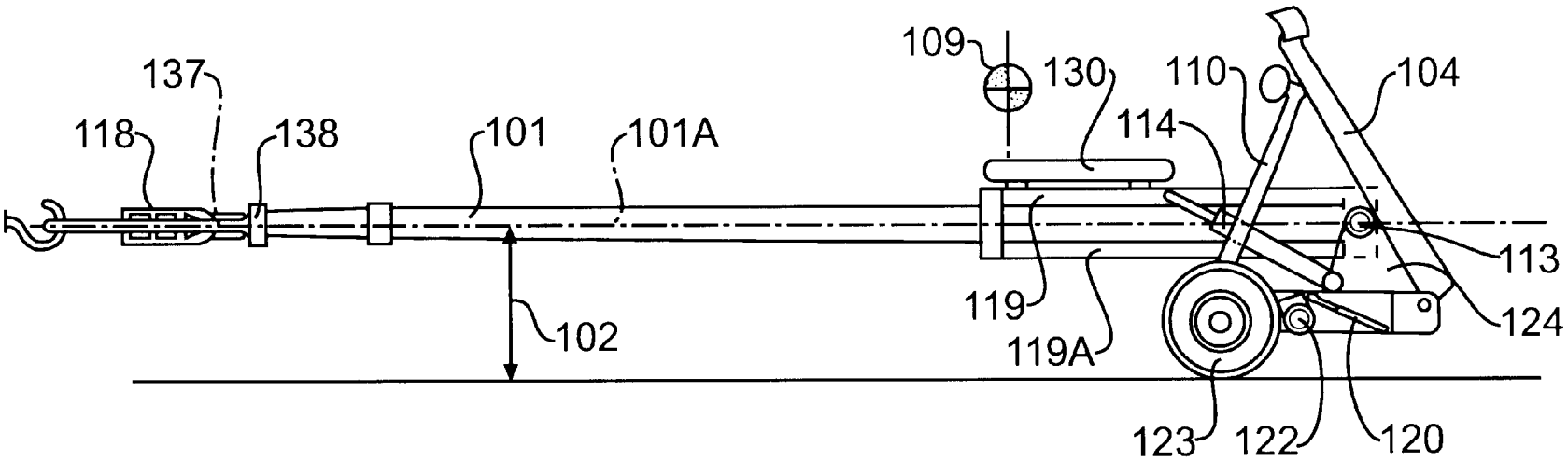
FIG. 3 shows a side elevation of the howitzer of FIG. 2 in the towed mode.
Figure 4:
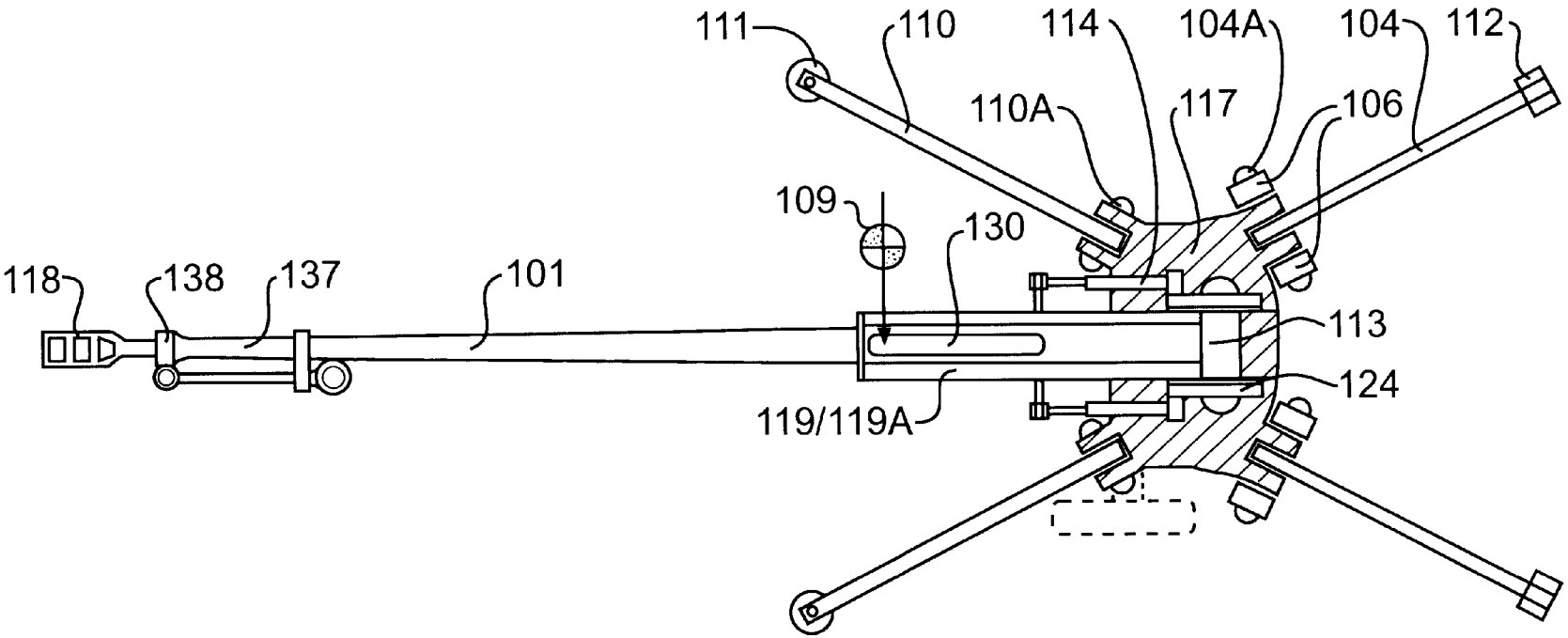
FIG. 4 shows a plan view of the howitzer of FIG. 2 in the ready-to-fire mode.

In FIGS. 2, 3 and 4, the same reference number is used for the same component as shown in FIG. 1 but preceded by one hundred, e.g. 1 and 101.

The key features of the design will now be described either singly, or in related groups.

1. Greatly lowered Trunnion Bearing Height.

2. Location of Barrel, including full recoil length, forward of trunnion bearing.

3. Single fabricated chassis.

4. Self-digging spades attached directly to chassis.

5. Positive out-of-balance.

17. Use of lightweight alloys and construction techniques.

The most readily apparent feature of the lightweight design is its low overall height as compared to the traditional design. The key factor in the design is the distance 102 of the axis 101A of barrel 101 when in the horizontal position, which is about 650 mm above ground level, compared to over 1500 mm for distance 2 for the gun in FIG. 1. The next most apparent feature is that the trunnion bearing 113 of trunnion support structure 124 is located to the rear of the extreme recoil position of barrel 101 and lies on the axis 101A. This makes the design a hybrid between that of a conventional field howitzer and a mortar. As shown by the centre of gravity 109, there is positive out-of-balance.

It is a normal design criteria that structures should be stable under the whole range of operating conditions. However, it is a particular and novel feature of the present invention that a positive out-of-balance is provided. Because of the very low weight of this ordnance, it is essential that what weight there is, is used in the most effective manner in the most arduous mode of operation, i.e firing. Thus the design is such as to place the centre of gravity 109 as far forward of the trunnion 113 as possible, i.e. to create as much positive out-of-balance as practicable to counteract the overturning effect 108T of the recoil. Though the result of this design philosophy is to require front stabilisers 110 to give stability in non-firing modes, the net advantages are considerable. Detailed studies of a range of options indicate that the embodiment shown offers the best compromise between weight-saving on the whole ordnance (i.e after allowing for the weight of the front stabilisers 110) and minimising the net recoil overturning moment 108T.

The trunnion support structure 124 is carried by a platform/chassis 117. Both these structures are fabricated from low weight, high strength alloys, in which metals such as titanium, magnesium and aluminium etc. are important constituents. Other high strength, low weight materials, e.g glass and carbon fibre reinforced plastic, may be used where appropriate. The design of the trunnion support 124 and platform/chassis 117 structures uses techniques not usually associated with artillery weapons to give robust lightweight components.

The underside of the platform/chassis 117 is convex so that it will rest naturally on all normal types of terrain to give a stable 3-point support with the front stabilisers 110. (See points 6 and 7 later.) At the rear of the platform/chassis 117, rear trail legs 104 are fitted via a hinged joint 104A. Also incorporated in these hinges are self digging spades 106. The method of hinging is such that the rearwards and downwards direction of the recoil forces causes spades 106 to lock against the rear of platform/chassis 117, i.e. the spades are, in effect, fast with chassis 117 and not located at remote points connected by 'resilient' trail legs 4 (FIG. 1).

Features 1–4 and 17 combine to give the following advantages:

i) Greatly reduced mass of metal in the trunnion and chassis structures.

ii) Greatly reduced turning moments due to recoil forces.

iii) High out-of-balance which acts to oppose the turning moment 108T due to the recoil.

These factors act synergistically because the reduced recoil moment requires less mechanical strength in the trunnion support structure 124, allowing a greater choice of lightweight materials (Feature 17).

5. Positive of out-of-balance.

6. Front stabilisers to counteract out-of-balance in all normal ready-to-fire attitudes.

7. Short, light rear trail legs to resist overturning.

8. Hydraulic dampers in or near trail leg—chassis hinge.

The front stabilisers 110 are used to counteract the out-of-balance 109 of the howitzer. Thus in the normal ready-to-fire mode, there is a stable, three-point support provided by chassis 117 and the two feet 111 at the ends of the front stabilisers 110. The vertical reactions due to the howitzer's weight on the chassis 117 and on the front stabilisers 110 are indicated by arrows 108B and 108D.

The rear trail legs 104 are secured to the body by the composite hinges 104A, which also secure self-digging spades 106. Built in to the trail leg hinges 104A are hydraulic dampers (not shown). The design of these dampers basically involves hydraulic fluid flowing through an orifice. Under a steady load, the fluid flows through at a constant rate; however, if the load is greatly increased, only a minimal increase in fluid flow occurs.

The recoil force may be considered as consisting of three components:

a horizontal component, a vertical component and a turning moment 108T.

Referring to FIG. 2, the horizontal component of the recoil is balanced by the horizontal reaction 107 of the two spades 106 in the ground. Though no vertical component is generated when the howitzer is fired horizontally, as shown in FIG. 2, the vertical component of the recoil force (when the barrel is elevated) is balanced by the vertical reaction 108B from the ground via the convex base into chassis 117. The turning moment 108T is balanced by vertical reactions 108C on the feet 112 at the end of the rear trail legs 104, plus the out-of-balance 109. Because the dampers (not shown) are incorporated into the hinges 104A, the howitzer will tend to rotate clockwise slightly as the turning moment 108T is dissipated; as soon as this has been done, the howitzer will rotate back onto its forward feet 111 under the effect of the out-of-balance 109, possibly lifting rear feet 112 off the ground—the rear trail legs 104 will then slowly swing downwards under the control of the dampers (not shown) until feet 112 rest on the ground.

No dampers are incorporated in the hinges 110A for the front stabilisers 110 but these stabilisers can be locked in either the firing (FIG. 2) or towing (FIG. 3) modes.

Thus, a stable three-point support is provided in both ready-to-fire and recoil modes, i.e. 2×108D+108B and 2×108C+108B respectively. It will also be noted that spades 106 are hinged in such a way (104A), that the horizontal and vertical components of the recoil act to 'lock' them in their operative position. Any rotation of the howitzer due to turning moment 108T would probably occur about an axis roughly through the pair of hinges 104A. Because dampers are used in hinges 104A, their action will protect the rear trail legs 104 from excessive loading so that the scantlings of legs 104 may be minimised.

The importance of having spades 106 fast with chassis 117 should not be underestimated. The horizontal and vertical components of the recoil force are taken directly via the trunnion support structure 124 and the chassis 117 to ground as reactions 107 and 108B, respectively. Thus, these recoil components pass through robust structures directly to the ground. This is in sharp contrast with the conventional field howitzer (FIG. 1) where the horizontal component goes through long 'resilient' trail legs 4. The release of the strain energy in these resilient trail legs 4 is like a second recoil and the combined effect is to make the howitzer move about violently. In contrast, each recoil on the ultra lightweight field howitzer of the present invention provides the spades 106 and chassis 117 with an ever more stable base accompanied by a small degree of rotation due to the effect of the turning moment.

Thus, on the ultra lightweight field howitzer of the present invention, the spades 106 provide the anchor at the structures 124 and 117 where the recoil forces are generated. On conventional field howitzers, the anchor is remote and is effectively connected by a 'spring'.

To the casual observer, it may seem that the need to provide two front stabilisers is an additional weight penalty. However, this does not recognise the considerable advantages conferred by the out-of-balance, for example:

A) out-of-balance acts to oppose the recoil turning moment 108T.

B) the position of the trunnion bearing enables vertical and horizontal recoil components to go straight to ground and this allows;

i) short light rear trail legs 104.

ii) small light trunnion support structure 124.

iii) small light chassis 117.

Thus the net weight saving due to the above far exceeds that of front stabilisers 110.

9. Combined recoil and recuperator system.

10. Use of hollow interiors of structural members for accumulator gas reservoirs.

11. Barrel weight counterbalanced using gas springs.

Figure 5:
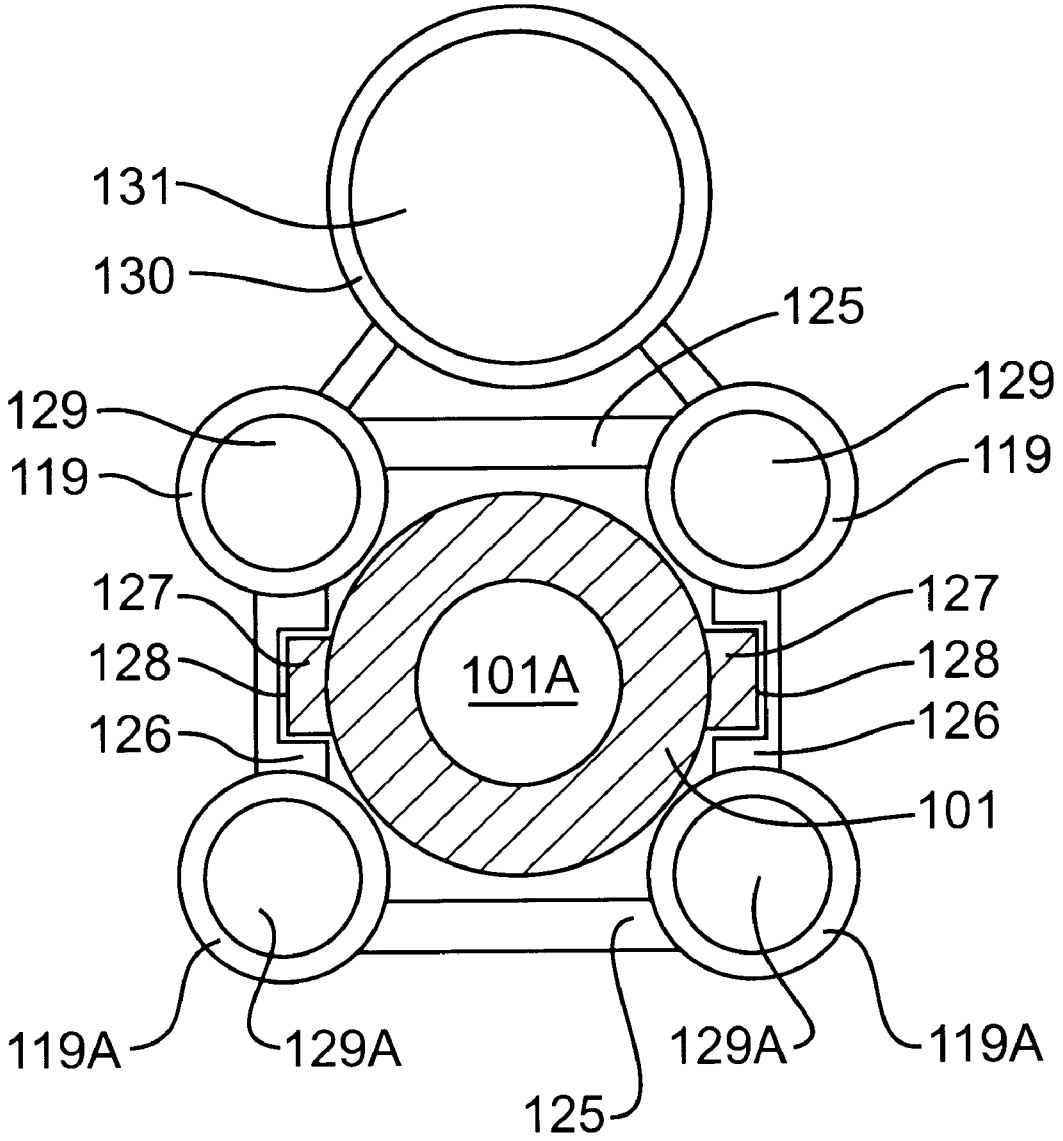
FIG. 5 shows a cross section through the barrel and cradle of the howitzer of FIGS. 2 to 4.

FIG. 5 shows a cross-section through a cradle which supports the barrel 101. The cradle has a rearward end which is pivotally mounted about the trunnion bearing 113 (see FIGS. 2, 3+4). The cradle consists of four hollow tubes 119 and 119A located in position by cross-members 125 and 126. Barrel 101 can move axially (101A) within the cradle via lugs 127 which slide in cut outs 128 in members 126. The internal volumes of hollow tubes 119 and 119A are designated 129 and 129A respectively. These volumes are cleaned and tested to the conditions laid down for pressure vessels. Cross connections (not shown) in cross-members 125 link the pairs of internal volumes 129 and 129A respectively. Similar connections may be provided in cross members 126 if required.

When the howitzer is fired, there is a massive release of chemical energy which causes barrel 101 to move rapidly backwards from a first to a second position, i.e it recoils. The energy of the recoil is absorbed in several ways, of which the main ones are:

i) by muzzle brake 118 (FIG. 4)

ii) in the recoil buffer and recuperator systems iii) by spades 106 and trail legs 104.

Muzzle brakes 118 are standard items on many gun barrels. They consist of a series of angled baffles, fast with the barrel, which deflect the exhaust gas rearwards and so exert a braking effect on the rearward motion of the barrel. Depending on the angle of the baffles and other factors, the magnitude and efficiency of the braking action may be varied. In this case the particular muzzle brake is chosen in such a way that, together with the design of recoil buffer and carriage geometry, the energy of the recoil is dissipated in the most acceptable manner. In this context, "carriage" covers the synergetic design of saddle (including trunnions), body, trail legs and spades.

Figure 6:
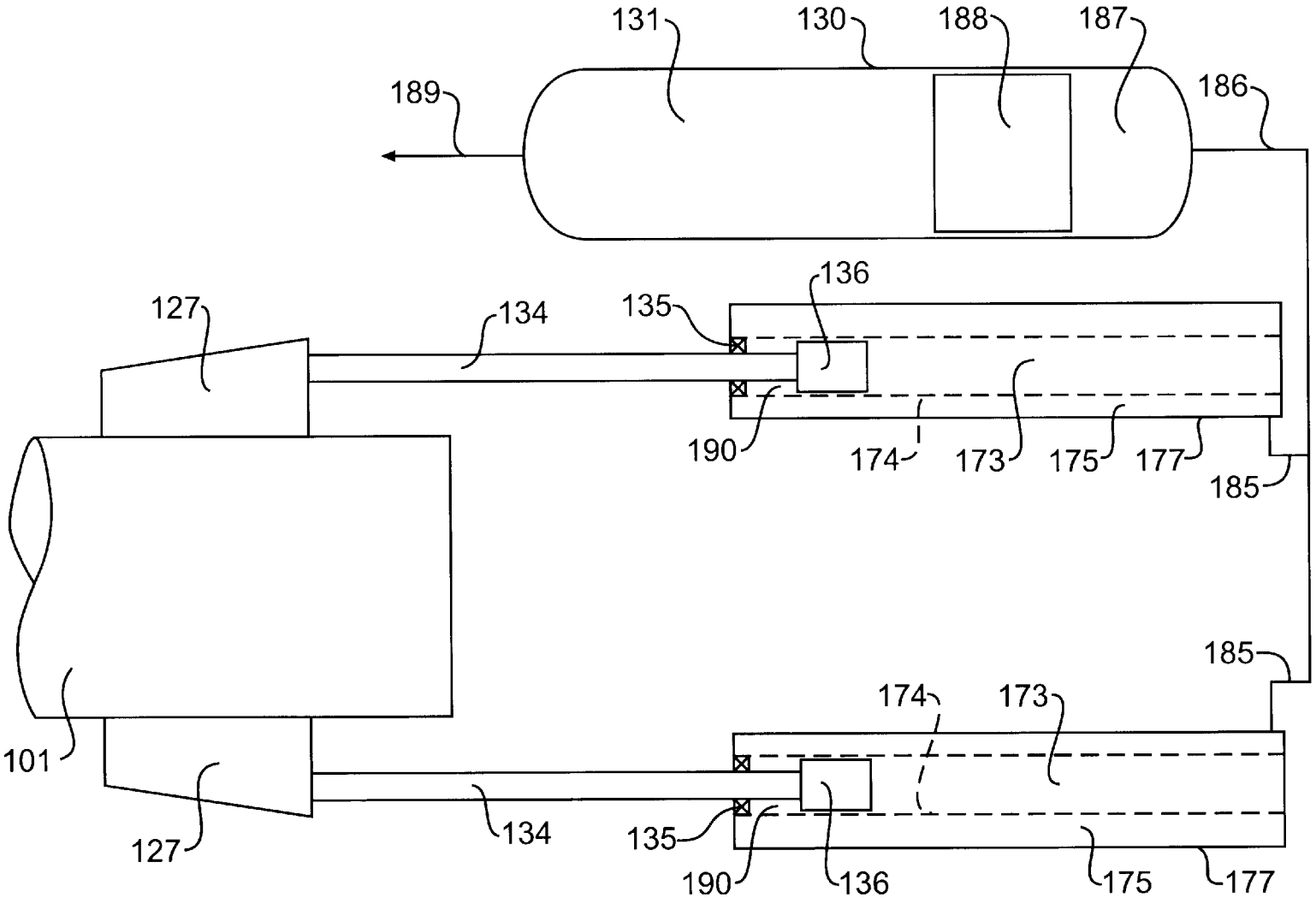
FIG. 6 shows schematically the action of the recoil buffer and recuperator of the howitzer of FIGS. 2 to 5.

Conventional recoil systems use a recoil buffer and a recuperator on each side of the barrel to dissipate the recoil energy symmetrically, i.e. there is a total of four cylinders. In the current disclosure, the recoil buffer and recuperator (FIG. 6) are combined into a single cylinder, so that there is only a total of two cylinders—one on each side of the barrel. This further contributes to the overall weight saving on the whole howitzer.

When the howitzer is fired, barrel 101 recoils to the right (FIG. 6) and lugs 127, via rods 134, force pistons 136 into cylinders 177. Inside cylinders 177 are perforated sleeves 174 so that the motion of pistons 136 causes hydraulic fluid in the central volume 173 of the cylinder to be forced, via perforated sleeves 174 into annuli 175 and thence, via pipes 185, 186 to accumulator 130. The perforations in sleeves 174 are not uniform but decrease in number and/or size from left to right. Thus, as pistons 136 move to the right, the number (and sizes) of perforations through which hydraulic fluid can flow is reduced and, hence, the resistance to rearward movement of barrel 101 increases. Consequently, by varying the size and/or number of perforations, the recoil characteristics may be varied to suit particular requirements. Piston rods 134 pass through seals 135.

Inside accumulator 130 is a floating piston 188 with hydraulic fluid 187 on the one side and inert gas 131 on the other. A pipe 189 connects accumulator 130 with two of the four tubular members 119 (or 119A) so that the total volume of inert gas on the left of piston 188 is that in spaces 131 and 129 (or 129A). During the recoil, essentially incompressible hydraulic fluid is forced from volume 173 via perforated sleeve 174 to annulus 175 and thence via pipes 185,186 to space 187 so forcing piston 188 to the left and compressing inert gas 131, 129 (or 129A). As the volume of inert gas 131 plus 129 (or 129A) is large compared with that swept by pistons 136, the pressure in accumulator 130 remains relatively constant.

When the howitzer is fired, pistons 136 are forced to the right raising the pressure in volume 173. The flow of an incompressible fluid through an orifice is proportional to the square root of the pressure difference across it; thus if the pressure difference is doubled, the fluid flow will increase by only 41%. Thus the recoil buffer action is to exert a high and increasing braking effect on the rearward motion of barrel 101 progressively bringing it to a halt. In contrast, the recuperator action is to advance the barrel back to the firing position at a slow steady rate. This is done by using the relatively constant pressure difference between that of inert gas 131, 129 (or 129A) and that in volume 173. Despite the smaller pressure difference, the fluid flows through perforated sleeves 174 at an appropriate rate to move barrel 101 back to the firing position in time for the next shot. Inert gas 131, 129 (or 129A) is precompressed to an appropriate pressure so that, under all conditions except when recoiling, barrel 101 is fully run out, irrespective of the angle of elevation.

The use of an hydraulic accumulator 130 on field howitzers is conventional but, because the additional gas volumes 129 (or 129A) are used to supplement volume 131, the overall size of accumulator 130 is reduced. This is a further weight saving. Also, due to the larger volume of pressurised inert gas 131, 129 (or 129A), the recuperator characteristics are better.

As stated previously, the location of the centre of gravity 109 gives the howitzer a large out-of-balance. If a conventional elevating gear only were to be used, the effort required would either be very large or an excessively high ratio would have to be provided. In either case, the gearing would be heavy and cumbersome in use. In order to minimise this effort, elevating cylinders 114 filled with compressed inert gas, are used to provide a 'counterbalancing' effect. Here again the gas-spring principle is used with the volume 129/129A of the other two of members 119/119A, providing an increased gas volume. By appropriately pressurising the inert gas, the force exerted by the cylinders 114 may be adjusted to be approximately equal to the out-of-balance of barrel 101 and related equipment, e.g 119, 119A, 130, etc. (A slight degree of underbalance is preferred). Under these circumstances, the barrel 101 may be elevated via a lightweight geared rack (with an acceptable ratio) using a conventional handwheel as only a minimal effort would be required.

As the angle of elevation of the barrel 101 increases, so the total volume inside the cylinders 114 and members 119 (or 119A) will increase thus lowering the pressure and degree of counterbalancing. However, this will be largely offset by the fact that the raising of the barrel 101 will tend to move the centre of gravity 109 to the right (FIG. 2) so that the net out-of-balance will also decrease.

In the particular example herein described, the volumes 129 of the two upper hollow members 119 are used in conjunction with cylinders 114 and the volumes 129A of the two lower members 119A are used as part of the recoil buffer. This arrangement is chosen to give the best line of action for cylinders 114 on the barrel/cradle assembly. However, this arrangement may be varied in accordance with particular requirements. Similarly the 2—2 division of the internal volumes 129/129A of members 119/119A may be varied, e.g 3 - 1 or 4 - 0, depending on requirements.

Considerable weight savings accrue from the use of the internal volumes 129/129A in conjunction with hydraulic accumulator 130. If these volumes were not used, equivalent volumes of pressure-resistant cylinders would be required instead. Not only would this contribute a pure weight penalty to the whole howitzer, but it would also present some problems as to where physically to locate the cylinders. If the cylinders were located on the barrel, this would increase the out-of-balance and hence the elevating problems while location on the chassis/platform 117 would impede access to other components and may require a larger (and hence heavier) chassis to be used.

By using the internal volumes 129/129A of members 119/119A there is little or no extra weight penalty. The scantlings of members 119/119A can be calculated by taking loadings and a suitable stress level for the material (including an appropriate factor of safety) and evaluating the desired metal thickness of the desired tube diameter. Then, from the range of standard thicknesses available in that diameter, the next thickness greater than that evaluated should be chosen, giving a further safety margin. In this case, the stress in the metal comes from the sum of the stress due to the loadings plus the stress due to the internal pressure. Since the stress due to internal pressure would probably be small compared to the loadings, e.g bending forces, it is quite probable that no increase in wall thickness would be required.

11) Barrel weight counterbalanced using gas cylinders

13) Radical new concept of elevation gearing

14) Resetting (rendering) device in elevation systems

As mentioned before, the elevation gearing must be designed to accommodate the load due to the net weight of the barrel, cradle, etc. It must also be accurate enough for adjusting the barrel to a precisely determined angle, e.g seconds of arc. Clearly, if there were no gas cylinder counterbalancing action, the load on the gearing would be much greater requiring massive gear elements and/or a high ratio. While a high ratio permits accuracy of angular adjustment, it also involves many turns on the handwheel which can be time-consuming, especially in a battle situation.

The solution to this problem is to provide gas-spring counterbalancing to make the barrel, cradle, etc., effectively "weightless" while providing a light, highly accurate damped elevating means to give an optimised new concept to elevation gearing.

Figure 7:
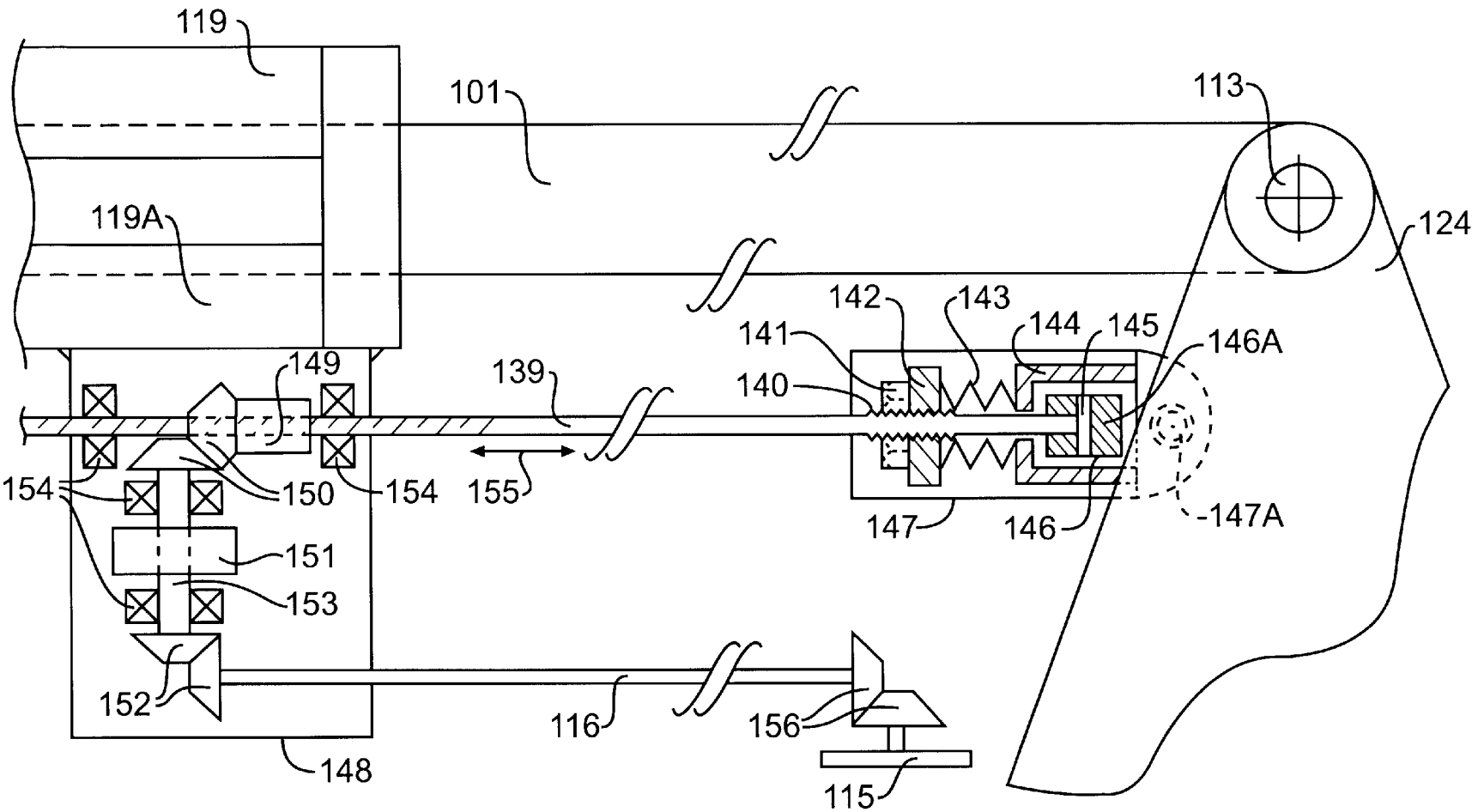
FIG. 7 shows a side elevation of the elevating mechanism of the howitzer of FIGS. 2 to 6.

The counterbalancing means has been described hereinbefore. The elevating mechanism is shown in FIG. 7. Essentially, it consists of a lead screw 139. pivotally fixed at its right hand end to the trunnion support structure 124 and passing through main elevation gearbox 148 near its left-hand end. The main elevation gearbox 148 is fast with the cradle 119, 119A (the non-moving part of the support for barrel 101), a resetter box 147 is pivotted at 147A to the trunnion support structure 124 and the arrangement is such that the lead screw 139 is parallel to the axis 101A of the barrel 101 and, preferably, vertically below it. The lead screw 139 passes through a planetary roller screw 149 in the gearbox 148 so that, as roller screw 149 rotates, the gearbox 148 moves along lead screw 139 in the direction shown by arrows 155. However, as both the main elevation gearbox 148 and the resetter gearbox 147 are positively located, the result is to cause the barrel 101 and cradle 119, 119A to be elevated (or depressed), i.e. angular motion occurs about the horizontal axis through the trunnion bearing 113 and about the pivot 147A to maintain the axis of barrel 101A parallel to that of lead screw 139.

The means of elevation is from an elevation handwheel 115, via bevel gears 156, elevation hand/drive 116, bevel gears 152, input shaft 153 and bevel gears 150 to roller screw 149. Lead screw 139 is located, and shaft 153 rotates, in bearings 154. A reverse locking mechanism 151 operates on the shaft 153 to maintain the elevation angle once preset.

The right hand end of lead screw 139 is mounted by a flexible tunable arrangement to protect the elevating system from shock loadings after firing. Near the end of the lead screw 139 is a screw threaded portion 140 on which a thrust nut 142 and lock nut 141 are secured. Thrust nut 142 bears on a spring 143, e.g. a series of spring washers, which is located at its other end by fixed thrust member 144. The end of the lead screw 139 terminates in a piston (and/or orifice) 145 in cylinder 146 full of hydraulic fluid 146A; this arrangement is, of course, a hydraulic damper. Thus, by adjusting the stiffness of spring 143 and the size of orifice 145 to vary the damping characteristics, the resetter gearbox 147 can be 'tuned' to damp out any movement in barrel 101 after firing and simultaneously protect the elevating system in general and lead screw 139 in particular. Frictional damping may be used in place of hydraulic damper 145, 146, 146A.

Thus to fire the howitzer, the elevation is set via elevation handwheel 115. After firing, the barrel 101 will recoil and the elevating mass will rock causing the lead screw 139 to move axially 155 with respect to the resetter gearbox 147. This causes spring 143 to compress/relax until the action of damper 145, 146, 146A stops the movement and spring 143 resumes its original length and the barrel elevation returns to that of pre-firing.

The discharge of a howitzer and its recoil are violent processes but, by carefully directing the recoil and allowing limited damped freedom of movement, these processes can be controlled by relatively lightweight members compared to where there is rigid mounting. Thus the example here of a lightweight damped elevation system coupled with the counterbalanced system offers a net weight saving over the conventional rigid gear arc, pinion and gearbox design. Also, the lighter system is more accurate, responsive and physically easier to operate.

15. Minimum size training bearing

16. Segmented arc training gear

The lowered trunnion height and consequently reduced recoil overturning moment 108T permits a reduction in the size of the trunnion support structure 124 on the chassis 117. Because of the way in which the forces are transmitted from the trunnion bearing 113 to the ground, the traversing arrangement (FIGS. 8 and 9) can be simplified to a small training bearing 158, 159 at the front, which acts as a fulcrum, and a thrust bearing fixed arc 160 at the rear. The actual training gear 163 is a small arc of a gear ring. This contrasts sharply with the massive ring bearings and full gear ring which have been used hitherto. The new design also provides a considerable saving of weight. Like the elevating gear, the training gear is operated by a handwheel via gearing (not shown). Here again, because of the lightweight of the trainable mass, a smaller, lighter gearbox is used than for the conventional field howitzer.

Figure 8:
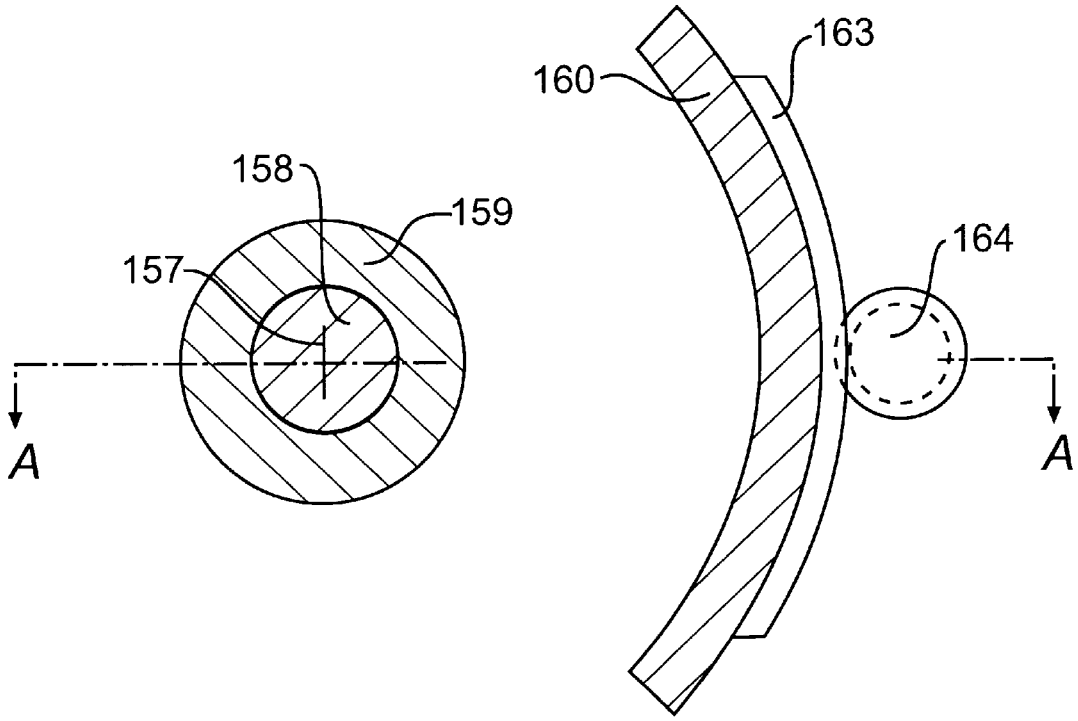
FIG. 8 shows a sectional plan view along line BB (FIG. 9) of the training mechanism of the howitzer of FIGS. 2 to 7.
Figure 9:
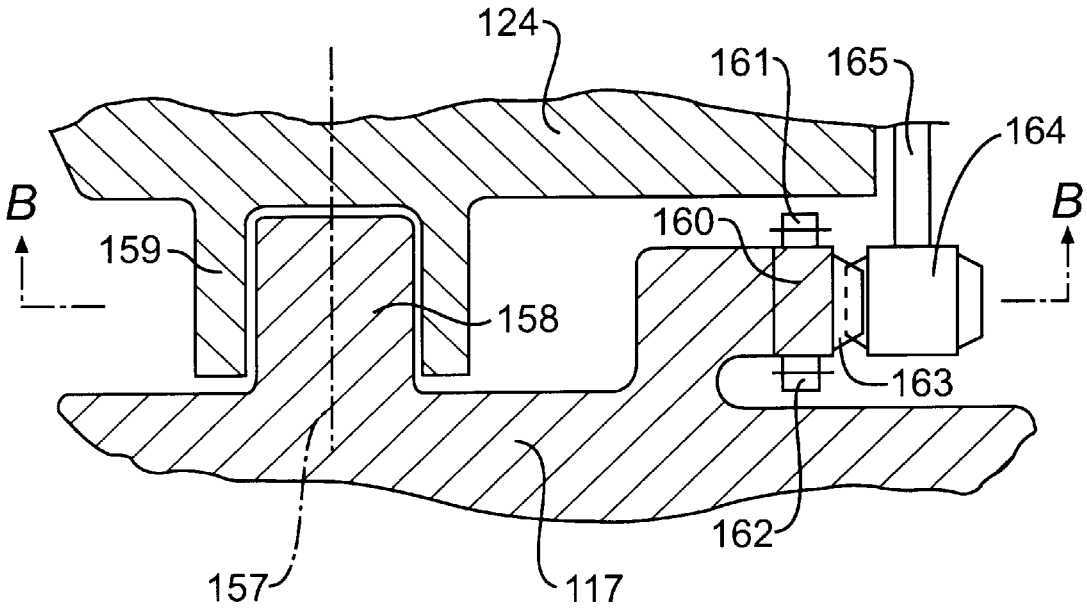
FIG. 9 shows a sectional side elevation along line AA (FIG. 8) of the training mechanism of the howitzer of FIGS. 2 to 8.

The principal of the design is shown in FIGS. 8 (plan) and 9 (elevation). The howitzer is trainable about vertical training axis 157 via a bearing, e.g with inner race 158 fast with chassis 117 and rotatable outer race 159 fast with the trunnion support structure 124. Upper 161 and lower 162 thrust bearings are pre-loaded onto bearing arc 160. These are shown as rollers, but any suitable type of bearing, or pad can be used. Rollers 162 support the positive out-of-balance and rollers 161 are loaded during recoil. The training gear arc 163 is machined onto the edge of the bearing arc 160 and a training gear pinion 164 driven by shaft 165 provides the training drive. The roller races 161 and 162 and the pinion 164 are all mounted on the trunnion support structure 124 though the actual mounting means are not shown to avoid confusing other detail.

5) Positive out-of-balance in all non-firing attitudes.

12) Provision for towing by muzzle of barrel

There are various methods by which the ultra lightweight howitzer can be converted into the towing mode. In one method, one or two men would support the end of the barrel 101 while lightweight wheels 123 are lowered hydraulically about pivot 122 by means of hydraulic cylinders 120 (see FIG. 3). The men would thus be supporting the positive out-of-balance. The other men of the team would then hinge up front stabilisers 110 and trail legs 104 (104B) and remove spades 106(106A) to be stowed on platform/chassis 117. A towing bracket in the form of a lunette 137 is then deployed by swinging it forward about hinge 138 and hooking it on to the towing vehicle. (In FIG. 2, the wheels 123 etc. have been omitted so as not to obscure other detail).

The positive out-of-balance resulting from the location of the centre of gravity 109 places a downward load, via lunette 137, onto the towing hook of the vehicle in conformity with safe towing practice.

The reduction of the barrel height 102 somewhat complicates the loading arrangements. However, one of the neatest solutions is to place the loading tray above the barrel 101. The position of a shell 121 is shown (FIG. 2), but not that of the loading tray or loading linkages, as these would obscure other detail.

4a) Self digging spades attached at/near ends of rear trail legs

Figure 10:
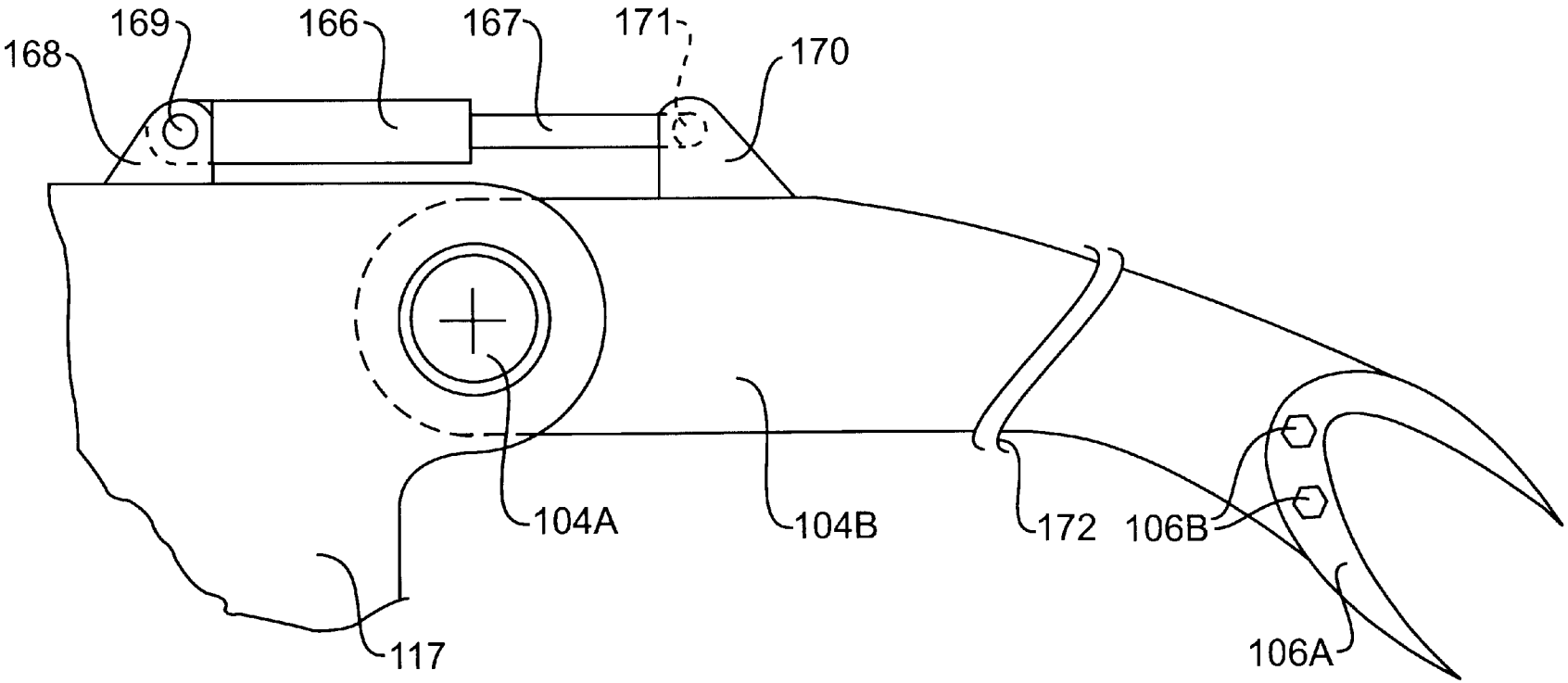
FIG. 10 shows a side elevation of a rear trail leg and spade of another howitzer of the present invention.

The problem with spades 6 (FIG. 1) attached at the ends of long flexible trail legs 4 is that the legs 4 are elastic and absorb much energy in the recoil mode, to be released as a further subsequent reaction. The net effect is that the whole ordnance 'bounces' around violently. An alternative to locating the spades adjacent to chassis 117 as in FIG. 2 is to secure them by bolts 106B at the ends of short, inelastic legs 104B (see FIG. 10 where the spades are denoted by reference numeral 106A) and to provide a hydraulic damper comprising cylinder 166 and piston 167 to allow the ordnance limited angular motion about hinge 104A. The hydraulic damper comprises a cylinder 166 pivotally mounted by joint 169 on to chassis fixture 168 and a piston in the cylinder and connected to a piston rod 167 pivotally mounted by joint 171 on to leg fixture 170. Symbol 172 indicates that the legs 104B are not shown to their full length.

The advantage of using such a system is that, after recoil, the chassis 117 and spades 106A will gently settle back onto the ground. The horizontal element 107 of the recoil would be spread over a larger area of ground than two spades 106 situated relatively close together. After several firings from the same spot, spades 106 would dig deeply into the ground stopping chassis 117 from settling down as firmly on the ground as desired. Spades 106A eliminate this possibility.

A further advantage of spades 106A at the end of trail legs 104B is that they enable minor design changes to be made to the chassis 117 giving a further slight lowering of the trunnion bearing 113. This gives a further level of improvement to many of the features described hereinbefore.

The present invention involves a large number of radical innovations to a standard item of field artillery. As will have been apparent, the whole raison d'etre for the new design is to save weight and so produce an ultra lightweight field howitzer. Though this radical approach has led to the introduction of some additional components, e.g. front stabilisers 110, the net affect is a new concept of ultra lightweight field howitzer. In addition, the new concept gives a much lower piece of artillery which is consequently much easier to conceal on a battlefield.

Throughout this description, reference has been made to the use of light and strong materials. As one of the foremost amongst this class of metals, titanium and its alloys are extensively used wherever the stress levels permit. Where structures can be designed on aerospace principles of combining lightness and strength, these will be used. These principles include where a given component can fulfil two or more duties.

Though the aim has been to produce a howitzer which, together with its crew and ammunition, can be carried by a single battlefield helicopter, and this aim has been achieved, smaller helicopters are also used on battlefields. The howitzer has thus been designed to separate quickly and easily into two or more parts so that, separately, the howitzer, crew and ammunition can also be carried by two smaller helicopters or land vehicles. Howitzers that can be readily separated into components and reassembled on a battlefield are much easier to transport in large numbers as the separate parts will pack better into the hold of a ship or aircraft than fully assembled items. An added feature of howitzers which can be separated into two or more major components is that a failure in one part can be rectified by replacement of the whole component allowing the faulty one to be returned to a workshop for subsequent repair.

Figure 11:
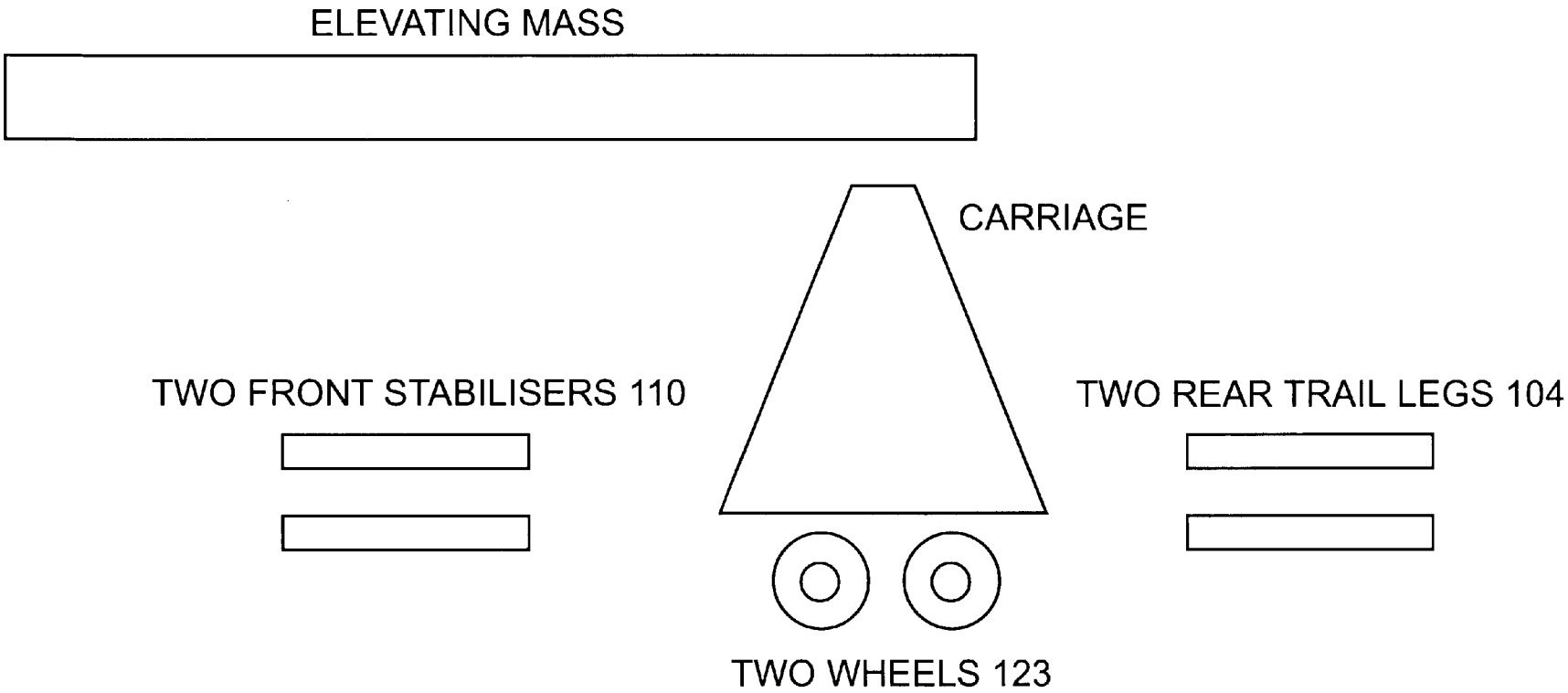
FIG. 11 is a simplified exploded view of the howitzer of FIGS. 2 to 10.

There are two main occasions when it may be necessary to separate the howitzer into parts. The first is on the battlefield where speed would be essential. In this case (FIG. 11), the howitzer would be separated into the "elevating mass" and "carriage" by the removal of the trunnion caps, etc. Each part would be light enough to be carried by a lorry or small battlefield helicopter. The second occasion could be when the howitzers are to be transported in large numbers from a base to a scene of possible conflict. Here, speed would not be as important as the density of packing. In this case, other parts such as stabilisers 110, trail legs 104B, wheels 123, etc, may be removed.

A further feature is a lunette 137 (FIG. 4) which may be hinged vertically downwards and locked to form a "leg" to support the muzzle end of barrel 101. This would greatly assist separation and reassembly of the howitzer's two main parts.

What is claimed is:

1. A field howitzer comprising:

i) a chassis;

ii) a howitzer barrel supported in a cradle and mounted in a trunnion bearing on the chassis so as to be pivotable about a horizontal axis; and iii) elevating means for pivoting the barrel about said axis, said elevating means comprising a geared manual means assisted by precompressed gas and said cradle being constructed from hollow members with the space inside the hollow members being used, at least partially, to provide the volume for the precompressed gas.

2. A howitzer as claimed in claim 1, wherein the howitzer barrel is mounted so as to be out-of-balance and the degree of assistance provided by the precompressed gas is sufficient to substantially counterbalance the barrel weight due to its positive out-of-balance.

3. A howitzer as claimed in claim 2, wherein the barrel weight is balanced by elevating cylinders pressurized by the precompressed Pas.

4. A howitzer as claimed in claim 1, wherein the elevating means comprises a lead screw, essentially pivotally fixed at one end and along which a planetary rotary screw may be screwed, said planetary rotary screw being fixed relative to the cradle but rotatable so that the resulting translational movement of said planetary rotary screw along said lead screw causes said cradle to move in a rotary direction about the trunnion bearing, thus elevating/depressing the barrel of the howitzer.

5. A howitzer as claimed in claim 4, wherein the essentially pivotally fixed end of said lead screw is provided with a flexible tunable mounting comprising:

i) a spring means aligned parallel to the axis of said lead screw, and ii) a damper;

wherein the damper has a spring constant, pre-load and resistance to motion which are adjustable to give a tunable system.

6. A howitzer as claimed in claim 5, wherein the spring means comprises a series of spring washers and the damper is a hydraulic damper.

7. A field howitzer as claimed in claim 1, wherein the howitzer barrel is further mounted on the chassis by means of a training bearing so as to be pivotable about a vertical axis, said training bearing comprising (a) a small central locating bearing having inner and outer bearing surfaces one of which is fast with the chassis and the other of which is fast with a support for the barrel and (b) a separate large diameter thrust bearing formed as part of a concentric arc on the opposite side of said small central locating bearing to the barrel.

8. A howitzer as claimed in claim 7 which includes a training rack integral with a part of the thrust bearing arc.

* * * * *